US005372451A

United States Patent [19]

Stewart

[11] Patent Number: 5,372,451

[45] Date of Patent: Dec. 13, 1994

[54] MODULAR SECTION DESIGN FOR ROAD SAFETY BARRIERS

[76] Inventor: Linda Jo Stewart, 105 S. Trail Ridge Rd., Edmond, Okla. 73034

[21] Appl. No.: 48,330

[22] Filed: Feb. 2, 1993

[51] Int. Cl.[5] ..... E01F 13/00

[52] U.S. Cl. ..... 404/6; 52/DIG. 9

[58] Field of Search ..... 404/6, 9, 10, 13; 256/13.1; 116/63 P, 63 R; 52/DIG. 9

[56] References Cited

U.S. PATENT DOCUMENTS

| | | | |
|---|---|---|---|
| 3,661,359 | 5/1972 | Walker | 256/13.1 X |
| 3,848,853 | 11/1974 | Way et al. | 404/6 X |
| 3,934,540 | 1/1976 | Bruner et al. | 404/6 X |
| 3,951,384 | 4/1976 | Hildreth, Jr. | 404/9 X |
| 4,186,913 | 2/1980 | Bruner et al. | 404/6 X |
| 4,288,061 | 9/1981 | Moreau | 256/13.1 |
| 4,785,577 | 11/1988 | Lederbauer | 404/6 X |
| 5,062,817 | 11/1991 | Wearne | 441/45 |
| 5,103,616 | 4/1992 | Nordberg | 52/DIG. 9 X |
| 5,121,680 | 6/1992 | Nordberg | 100/12 |
| 5,238,228 | 8/1993 | Moon | 256/13.1 |

FOREIGN PATENT DOCUMENTS

| | | | |
|---|---|---|---|
| 1441000 | 11/1988 | U.S.S.R. | 256/13.1 |
| 1733550 | 5/1992 | U.S.S.R. | 256/13.1 |

OTHER PUBLICATIONS

"sand barrels" as they, to my knowledge, are barrels such as of plastic filled with a material such as sand; in public use for more than one year prior to Feb. 2, 1993.

*Primary Examiner*—Ramon S. Britts
*Assistant Examiner*—James Lisehora

[57] ABSTRACT

A road safety barrier comprises an encasement in which vehicle tires are retained so that the central openings through the tires are aligned. End caps close the encasement but permit a coupling member, such as a pipe, to extend through the aligned openings of the tires and through apertures in the end caps. The coupling member can be connected at each end to adjacent barriers to form a barrier wall. Each of the components is separable so that construction and repair are facilitated.

1 Claim, 1 Drawing Sheet

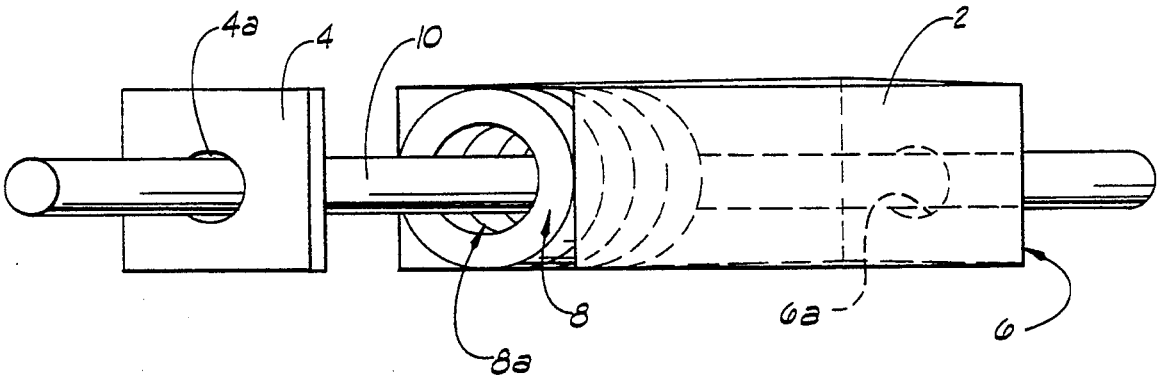
4a
4
10
2
8
8a
6a
6

MODULAR SECTION DESIGN FOR ROAD SAFETY BARRIERS

BACKGROUND OF THE INVENTION

This invention relates generally to road safety barriers and more particularly to such barriers which include used vehicle tires as at least one shock-absorbing medium.

SUMMARY OF THE INVENTION

The present invention provides a novel and improved road safety barrier.

The road safety barrier of the present invention comprises: encasement means for decreasing impact shock when a moving vehicle hits the encasement means, which encasement means has a hollow interior. The barrier also comprises a plurality of complete, used vehicle tires individually slidably disposed in separate but adjacent relationship within the hollow interior, wherein the tires are radially retained in coaxial alignment by the encasement means.

The invention preferably also comprises means for coupling with adjacent barriers so that a barrier wall can be constructed. As such, the present invention can also be defined as comprising: a container having a hollow interior; a plurality of vehicle tires disposed within the hollow interior so that central openings of the tires are aligned; and an elongated adjacent-barrier coupling member disposed axially through the aligned central openings. The recited container preferably includes the aforementioned encasement means as well as two end caps disposed at opposite ends of the encasement means, each of the two end caps having a central aperture through which a respective end of the coupling member extends.

Therefore, from the foregoing, it is a general object of the present invention to provide a novel and improved road safety barrier. Other and further objects, features and advantages of the present invention will be readily apparent to those skilled in the art when the following description of the preferred embodiments is read in conjunction with the accompanying drawing.

BRIEF DESCRIPTION OF THE DRAWING

The single drawing figure is a perspective view of a preferred embodiment of the present invention.

DETAILED DESCRIPTION OF PREFERRED EMBODIMENTS

The road safety barrier of the preferred embodiment shown in the drawing comprises a hollow modular section or container which includes an encasement 2 constructed in a four-sided rectangular boxed shape with open ends. Acceptable light-weight materials deemed compatible with the safety utility of the barrier are preferably used. Such light-weight materials are easily moved from storage to job site by ordinary road building equipment. End caps 4, 6 with central apertures 4*a*, 6*a*, respectively, can be used to close the open ends of the encasement 2.

Auxiliary impact deflection is provided by the filler of a plurality of complete, used vehicle tires 8 placed upright within the modular section in a manner that the end cap center holes 4*a*, 6*a* shall line up with the central hollows or openings 8*a* of the tires 8. As apparent from the drawing, the tires 8 are individually slidably disposed in separate but adjacent relationship within the hollow interior of the encasement 2. The used tires provide an impact barrier to absorb impact and deflect vehicles back onto adjacent easements or lanes. Such filler of used tires is a suitable utility of a disposable product. As shown in the drawing, the tires 8 are preferably disposed with the outer circumference (and any remaining tread thereon) in contact with the four inner sides of the encasement 2, whereby the tires 8 are radially retained in coaxial alignment by the encasement 2. As apparent from the drawing, the end caps 4, 6 retain the tires 8 longitudinally in the encasement 2, whereby the tires 8 are fully enclosed by the container.

Means for connecting the modular sections is provided by an elongated adjacent-barrier coupling member 10, such as a rigid pipe run axially through the end cap holes 4*a*, 4*b* and through the complete modular section including through the aligned center openings 8*a* of the used tire filler and utilizing traditional pipe connectors between each modular section. The rigid pipe threaded through the middle of each modular section and connected to another should provide a semi-rigid wall to prevent vehicles from crossing over medians to enter opposing traffic or to prevent access to other dangerous hazards.

The aforementioned design of the modular section can be placed by forklift or any other similar "spearing" device by insertion into the hollow center. The complete unit can be maintained with a minimum of effort. Damaged units can be replaced singly and units displaced by an impact can be rearranged by earth moving equipment.

The specifications of measurement are dependent upon the measurement of tires and pipe selected. The specification of materials is dependent on suitability and availability of said materials. Utility of the invention is not provided by any particular set of definitive measurements or materials; however, examples relevant to the pictured embodiment are as follows.

Specification of Measurements of the Encasement

Measurements shall vary but conform to the size of the tires used as filler to absorb impact. A complete section of a particular implementation may have a size of 12′ in length, 2.5′ in height, and 2.5′ in width, for example.

Specification of Measurement of End Caps

The fitted end caps 4, 6 should conform to fit the height and width to provide a snug fit to contain the tires 8 within the modular section. Each end cap will be pre-formed with the center hole of sufficient measurement to allow a rigid pipe to be placed through the end cap and through the upright tires, and to exit the opposite end cap.

Specification of Measurement of Rigid Pipe

The rigid pipe 10 should equal or exceed 4″ in diameter to provide sufficient resistance and rigidity. Connectors utilized shall conform to the measurement of the rigid pipe used.

Specification of Material Used for Modular Section

The modular section or boxed encasement 2 and fitted end caps 4, 6 will be formed from suitable materials that shall conform to the principle of decreasing impact shock when a moving vehicle hits a solid barrier. With that criteria, materials considered will be limited to material similar to rubber, foam board, plastics, etc. that can be pre-shaped into an encasement as described.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A road safety barrier, comprising:

a four-sided container having a hollow interior, two open ends and an end cap snugly received on each of said open ends, each said end cap having a hole centrally located therein;

a plurality of vehicle tires disposed within said hollow interior, said tires each having a central opening, the central openings of the tires being aligned with one another and with the holes in said end caps; and a rigid elongated cylindrical adjacent-barrier coupling member extending axially through said aligned central openings and said holes in said end caps so that said coupling member is adapted for coupling with another safety barrier to construct a road safety barrier wall.

* * * * *